United States Patent [19]

Sitter

[11] 4,016,741

[45] Apr. 12, 1977

[54] BRACELET DOMER

[76] Inventor: Spencer B. Sitter, Rte. 3, Box 86N, Santa Fe, N. Mex. 87501

[22] Filed: Dec. 29, 1975

[21] Appl. No.: 644,633

[52] U.S. Cl. ..... 72/415; 29/160.6

[51] Int. Cl.[2] ..... B21D 17/02; B21D 22/02

[58] Field of Search ..... 29/160.6; 72/406, 415

[56] References Cited

UNITED STATES PATENTS

| | | | |
|---|---|---|---|
| 264,541 | 9/1882 | Lambert | 29/160.6 UX |
| 1,187,141 | 6/1916 | Goldberg et al. | 72/415 |

FOREIGN PATENTS OR APPLICATIONS

| | | | |
|---|---|---|---|
| 88,415 | 6/1958 | Netherlands | 72/415 |

*Primary Examiner*—Milton S. Mehr
*Attorney, Agent, or Firm*—Wendell Coffee

[57] ABSTRACT

A hand powered machine forms jewelry blanks into domed bracelets between guided toroidal convex hammer and concave anvil. The shaping of the bracelet is by a combined pressing and pounding action.

16 Claims, 10 Drawing Figures

Fig. 5
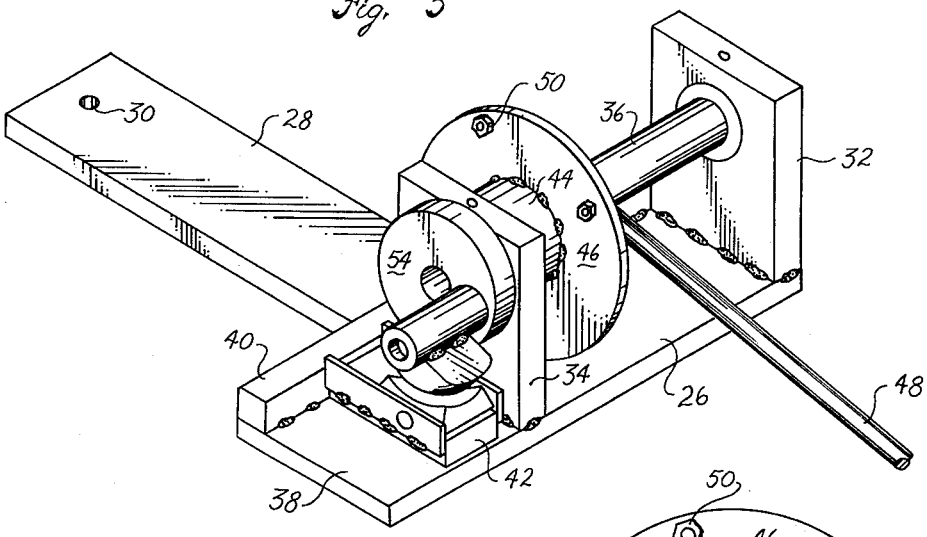
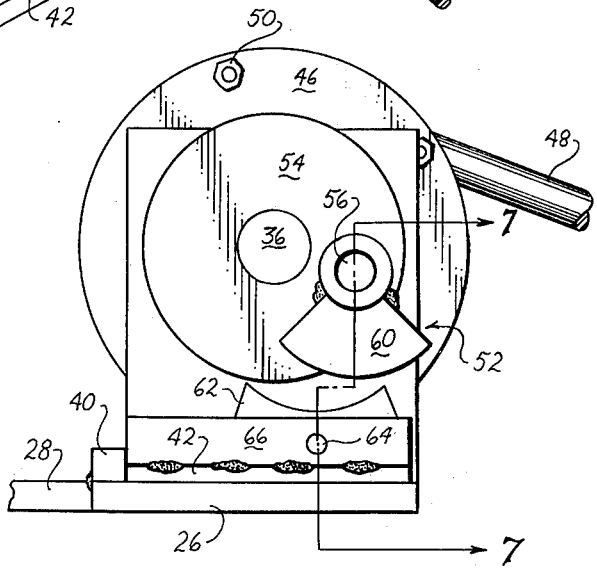
Fig. 7
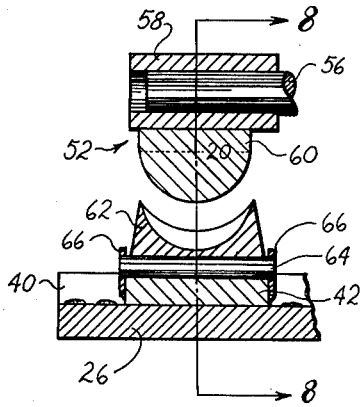
Fig. 6
Fig. 8
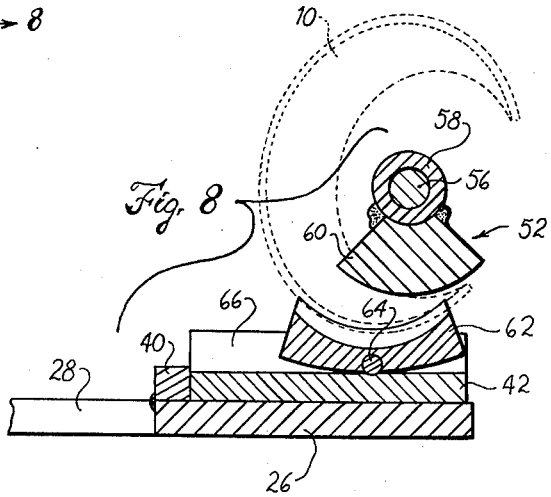

BRACELET DOMER

BACKGROUND OF THE INVENTION

1. Field of the Invention

This invention relates to a metal working machine for the manufacture of jewelry. (29/160.6)

2. Description of the Prior Art

The people of many cultures of the World adorn themselves with metal bracelets; therefore, the craftsmen in many cultures for centuries have made bracelets to be worn on the wrists. Many of these bracelets are flat. More specifically, they might be considered a segment of a cylinder. These are rather easily fashioned by the craftsmen.

Also, craftsmen make bracelets which are domed, or "donut shaped" or, more specifically, toroidal or having a segment of a toroid.

For the purposes of this application, the circle of the toroid that encircles the wrist will be called the "major circle" and will have a "major diameter" and the cross section will be called the "minor circle" and will have a minor chord. It is recognized that neither are true circles, but more nearly ellipsis. For simplicity the terminology "circle" and "diameter" will be used.

Instead of a full minor circle, the segment of the toroid usually includes only a segment of the minor circle. Also, rather than the minor circle being solid, (which is heavy on the arm), it is only the shell or the toroidal surface. The domed bracelet, or a segment of a toroid, has a particularly opulent appearance and often has the appearance of being solid and containing a mass of precious metal therein. Such domed bracelets are light but difficult to form.

The American indians of the Southwest residing in the general area of New Mexico, Arizona, Nevada, Utah and Colorado made domed bracelets before this invention. According to their techniques for making silver domed bracelets, the curved surface or dome is formed by hammering a blank with a hammer against a wooden block. The craftsmen generally work with silver which is a ductal metal.

More sophisticated machines might be designed to form a domed bracelet, but their use might be prohibited inasmuch as to find a commercial market the jewelry must be "hand made." There seems to be a market for jewelry items of this nature only if they are made by manual-operated tools and machines.

A search made upon this invention before the patent application was prepared disclosed the following patents considered by the Searcher to be pertinent:

| | |
|---|---|
| Lambert | 264,541 |
| Schulmm | 300,140 |
| Evans | 1,604,222 |
| Carlsen | 1,879,078 |

SUMMARY OF THE INVENTION

NEW AND DIFFERENT FUNCTION

I have invented a hand operated machine which forms ductile metal blanks into the complex geometric shape of a domed bracelet. I have developed this machine so that the power requirements are small; therefore, the machine can be hand operated.

Not only does it form the complex shape of a toroidal surface, but, in addition to this, it does it in such a way it does not disturb designs placed upon the metal, i.e., the metal may first be embossed with designs while it is flat; thereafter, the metal may be domed or bent to the toroidal shape without obliterating or defacing the designs previously placed upon the bracelet blank.

OBJECTS OF THIS INVENTION

An object of this invention is to dome bracelets.

Another object of this invention is to provide a machine to hand-make jewelry.

Further objects are to achieve the above with a device that is sturdy, compact, durable, lightweight, simple, safe, efficient, versatile, and reliable, yet inexpensive and easy to manufacture, install, adjust, operate, and maintain.

Other objects are to achieve the above with a method that is versatile, rapid, efficient, and inexpensive, and does not require skilled people to install, adjust, operate, and maintain, nor highly skilled people to operate.

The specific nature of the invention, as well as other objects, uses, and advantages thereof, will clearly appear from the following description and from the accompanying drawing, the different views of which are not necessarily to the same scale.

BRIEF DESCRIPTION OF THE DRAWING

FIG. 5 is a perspective view of a machine according to an embodiment of my invention.

FIG. 6 is an end view of the machine shown in FIG. 5.

FIG. 7 is a sectional view taken substantially on line 7—7 of FIG. 6.

FIG. 8 is a sectional view taken substantially on line 8—8 of FIG. 7 with the bracelet shown in broken lines in the position being formed.

DESCRIPTION OF THE PREFERRED EMBODIMENT

Figure 2:
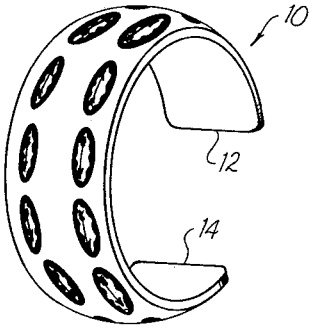
FIG. 2 is a perspective view of a finished domed bracelet.
Figure 3:
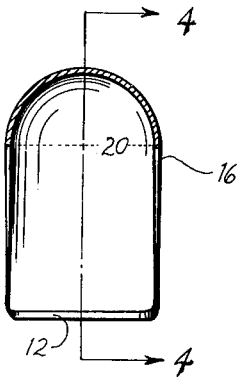
FIG. 3 is a sectional view of the finished bracelet taken generally on line 3—3 of FIG. 4.
Figure 4:
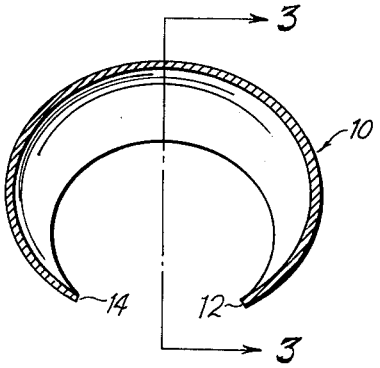
FIG. 4 is a sectional view of a finished bracelet taken on line 4—4 of FIG. 3.
Figure 9:
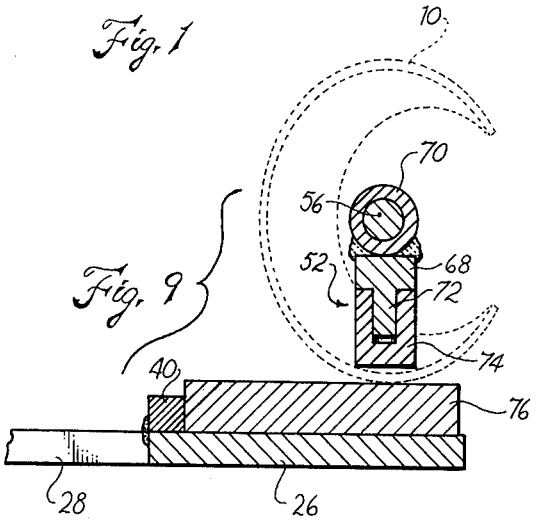
FIG. 9 is a view similar to FIG. 8, but showing a different pair of dies thereon, the bracelet being formed thereon shown in broken lines.

A domed bracelet is illustrated in FIGS. 2, 3, and 4, of the drawing. Basically, the braclet is a segment of a toroid. I.e., the main portion of bracelet 10 is a portion of a major circle (FIG. 4). Although the circle is somewhat distorted to better conform to the cross section of the wrist upon which it is to be worn, it has the major appearance of a circle. Of course, the circle is broken between tip 12 and tip 14 so the wrist can be slipped at the side into the bracelet and then rotated so the bracelet fits around the wrist. The cross section, as seen in FIG. 3, is a segment or is an arc of a small circle. The shape may not be an exact circle, but it is proximate; the small circles being more proximate than the large circle. However, most of the domed bracelets will be less than a semicircle. The distance from one edge 16 of the bracelet to the opposite edge is referred to as the minor chord 20 and is shown by a dashed line on FIG. 3. The major circle will be in a plane. The chord 20 will be at a right angle to the plane of the major circle.

Figure 1:
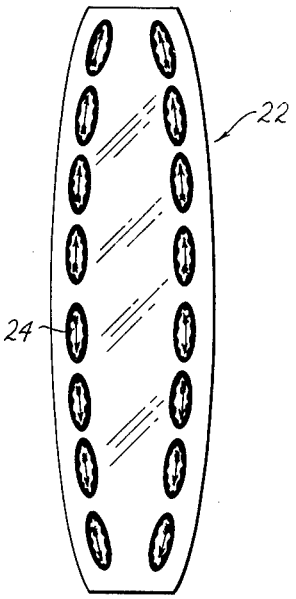
FIG. 1 is a plan view of a blank to be domed and curved into a bracelet.

The bracelet 10 is formed from blank 22 (FIG. 1). As illustrated, the blank is embossed or stamped with design 24 while it is in the flat position. It will be understood that the design 24 may be stamped on the metal much easier when it is still a flat blank 22 rather than after it has been domed into the toroidal shape as shown in FIGS. 2, 3, and 4, which was well known before my invention.

A machine according to my invention has base plate 26 (FIG. 5). Tongue 28 extends from the base plate rearwardly. Hole 30 in the tongue 28 provides for attachment of the tongue and thus the base of the machine itself to a workbench. It is necessary to keep the front of the machine unobstructed because the craftsman will be positioned there.

Pedestal 32 is attached to the base plate as by welding at one edge of the base plate 26 as seen in FIG. 5. Pedestal 34 is attached to the base plate at approximately two-thirds of the length of the base plate from pedestal 32 and one-third from the opposite edge of the base plate. Shaft 36 is journaled in suitable bearings to the pedestals 32 and 34. One end of the shaft 36 extends through the pedestal 34 so it overhangs the portion of the base plate referred to as the anvil seat 38.

Bar 40 is attached to the back of the base plate 26 for the length of the base plate. The bar 40 assists in positioning anvil block 42 upon the anvil base and, also reinforces the pedestals 32 and 34. In addition, the bar strengthens the entire machine.

Collar 44 is attached to the shaft 36 by a diametrical bolt (not shown, but readily understood by all craftsmen). Disc 46 is attached as by welding to the collar 44. Handle 48 is attached to the disc by a pair of bolts 50. It is important that handle 48 be firmly connected to the shaft 36 and, also, when hammer 52 is in the working position, the handle 48 is angled downward. This is important because the action of doming the bracelet is not a straight, pressing action, but includes a hammering or pounding or forging action and for the craftsman to have the feel of the hammer 52 against the metal it is necessary that there be a solid, firm connection between the handle 48 and the shaft onto the hammer. For the craftsman to have the proper feel and working stance it is necessary that it be angled downward or below center when the shaping of the metal is taking place.

Crank disc 54 is attached to the shaft 36 on the outside of the pedestal 34. This connection is by welding so that it is securely attached. Crank pin 56 is attached to the crank disc 54. The crank pin 56 being parallel to the shaft 36, the crank disc 54 itself is in the form of a crank. However, a full solid disc of considerable thickness is preferred to have the desired inertia to transmit the impact or blows to the metal being formed.

Hammer 52 is formed of tube or sleeve 58 which telescopes over crank pin 56 as readily seen in FIGS. 5 through 8. Attached to the sleeve is quadrant or arc or segment 60 of a convex toroid. Segment 60 is securely attached as by welding to the sleeve 58. The convex surface of the segment 60 will be a portion of a true toroid. I.e., as seen in FIG. 7, the lower convex surface will be a segment of a circle, which will be the minor circle. The cord shown in dotted lines as 20 will be parallel to the crank pin 56. The convex surface as seen in FIG. 6 will be a quadrant of a circle; so, it may be seen that the movement of such will be that the movement is in the same plane as is the major circle as seen in FIG. 6. The outside diameter of the sleeve 58 is smaller than the diameter of the major circle. Therefore, the entire hammer 52 will fit within the perimeter or circumference of the major circle. As may be seen more clearly in FIG. 8, when the bracelet is being formed, the bracelet will fit around the hammer, the bracelet being shown in broken lines in FIG. 8. The crank pin 56 is near bottom dead center when working so the crank 54 acts like a toggle and it has a great deal of force as a press. I.e., large movement on the handle 48 results in only small movement of the hammer 52 toward the anvil 42.

The anvil has as the major portion the anvil block 42 which, as stated before, rests upon the anvil seat 38 of the base of the machine. The anvil includes rocker block 62. The rocker block 62 will have a concave toroidal surface thereon. This surface will likewise be the surface of a true toroid having a major circle and a minor circle. The concave toroidal surface of the rocker block 62 will be slightly larger than the convex toroidal surface of the hammer 52; there being enough space or clearance between the two to allow for the thickness of the blank being formed.

I have found that it is best if the anvil is not rigidly attached to the base, but is free to move. The anvil block 42 merely sits on the flat anvil seat 38. The bar 40 acts as a backstop, but other than this the anvil block 42 is free to move to any position upon the anvil seat 38. Since the shaping is by impact, it is necessary that it be firmly seated and have no give up and down. However, it is desirable that it be free to rock or to change angle position in the plane of the major circle. I have achieved this by mounting it on rocker shaft 64. Referring to FIGS. 6, 7, and 8, it may be seen that two side plates 66 are welded on either side of the anvil block 42. In use, these plates 66 will be parallel to the plane containing the major circle. The bottom of the rocker block 62 has a cylindrical slot or hole therethrough. This cylindrical slot is circular in cross section and about three-quarters of the circle would be contained within the rocker block 62 so the rocker block rests upon a portion of the shaft 64, however, the shaft is seated upon the anvil block 42. The bottom of the anvil block is a rocker or a segment of a cylinder. The shaft extends through the side plates 66 so the rocker block cannot be removed from the anvil block, but it is free to rock or change its angle position thereon. This, together with the fact the anvil block itself is free to move on the anvil seat, makes it so the concave surface of the anvil can be moved so there is no bind with the convex surface of the hammer. It will be noted that there is no particular position of the hammer 52 upon the crank pin 56. I.e., the hammer can be pushed on until the sleeve 58 butts against the crank disc 54.

The orientation of the rocker 64 is parallel to the axis of the cylindrical bottom of the rocker block 62 and is also parallel to the minor chord of the toroidal surface of the hammer and anvil which makes it also parallel to the crank pin 56 and the shaft 36.

The center of the major circle is coincidential with the center of the sleeve 58 and, therefore, with the crank pin 56. Therefore, the toroidal surface of the hammer 52 bears the same at point of contact with the anvil regardless of whether the sleeve 58 is twisted or turned on the crank pin 56. Analysis of the movement of the hammer 52 against the anvil block 62 will show that there is considerable lateral movement as well as downward movement. However, because of the rotation or rocking of the hammer sleeve 58 on the crank pin 56 and the rotation or rocking of the anvil block 62 on the rocker shaft 64, the resulting movement on the bracelet 10 being domed is primarily downward with minimum side slip. Thus, it is possible to have the work done near bottom dead center with the great force achieved at that angle.

I have found it desirable to use different heads on the hammer other than the convex toroidal shape. Specifically, I have found it desirable to use one which has a flat, circular surface. This is achieved by welding adapter 68 to sleeve 70 which telescopes over the crank pin 56. the adapter has circular pin 72 which terminates with a shoulder adjacent to the sleeve 70. Cylindrical head 74 is telescoped over the pin 72 against the shoulder. The cylindrical head 74 has a circular flat face. Therefore, this hammer may be used to flatten a portion of the bracelet. I have found it particularly pleasing in design to have these flat portions upon the bracelet. The flat head 74 can be used to make a flat, circular portion at the apex of the bracelet, a circular hole cut therethrough and then a watch mounted on the inside of the domed bracelet to show the face of the watch through the cutout. Other specific designs could be placed on the flattened portion of the bracelet. The particular size of the flat circle can be of any desired size by having interchangeable heads 74. Also, a design for embossing can be put on the bottom of the head 74. Obviously as long as the internal bore in the head 74 fits the pin 72, any number of changeable heads can be used. As may be seen, head 74 is used with flat anvil 76.

Figure 10:
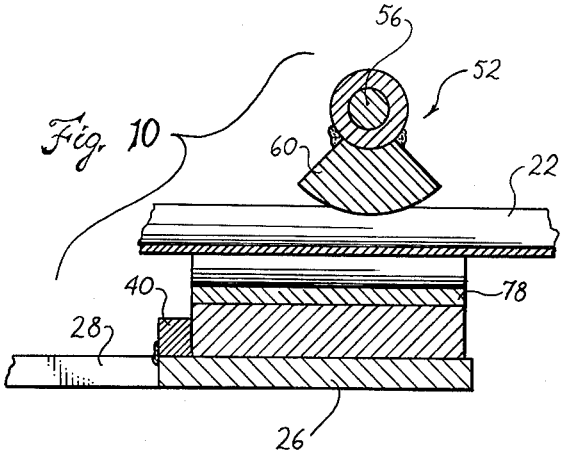
FIG. 10 is a view similar to FIG. 8 showing the machine with a different concave die thereon and also showing a blank after being partially formed between the dies.

I have also found it desirable to use another specifically shaped anvil. Anvil 78 has a concave hemicylindrical shape as shown in FIG. 10. I have found in certain instances to shape the domed bracelet it is desirable to first form the general curve of the minor circle by placing the blank 22 first upon this semicylindrical concave anvil 78. I have found it desirable to use hammer 52 having a convex toroidal surface of a segment 60, as previously described and shown in FIGS. 5 through 8.

As an aid to correlating the terms of the claims to the exemplary drawing, the following catalog of elements is provided:

| | |
|---|---|
| 10 bracelet | 46 disc |
| 12 tip | 48 handle |
| 14 tip | 50 bolts |
| 16 edge | 52 hammer |
| 18 edge | 54 crank disc |
| 20 minor chord | 56 crank pin |
| 22 blank | 58 sleeve |
| 24 design | 60 segment, convex |
| 26 base plate | 62 rocker block |
| 28 tongue | 64 rocker shaft |
| 30 hole | 66 plates |
| 32 pedestal | 68 adapter |
| 34 pedestal | 70 sleeve |
| 36 shaft | 72 pin |
| 38 anvil seat | 74 head |
| 40 bar | 76 anvil |
| 42 anvil block | 78 cylindrical anvil |
| 44 collar | |

As previously stated, it is desired that the handle be angled downward at the time the hammer is working the metal on the anvil. Likewise, it is desired that the crank pin 56 be near bottom dead center. If the axis of the crank is defined as the line between the center of the shaft 36 and the center of the crank pin 56, it may be seen from FIG. 6 that the axis of the crank and the handle 48 are approximately parallel. In any event, I found it desirable to have the angle between the handle and the axis of the crank less than 45° so that the proper relationships discussed above exist.

I have found that blind persons can operate my machine. A U-shaped stop on the hammer aids sightless operation. One leg of the U is attached to the convex segment 60 at about the arrow head of the numeral 52 in FIGS. 6 and 8. The other leg strikes the rocker block 62. Both legs are parallel to the crank pin 56.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A machine to form a domed bracelet from a flat ductile metal blank comprising:

a. a base,
b. a lever connected to the base,
c. a pin connected to the lever,
d. a convex hammer journaled to the pin on the lever,
e. a concave anvil on the base positioned so that the convex hammer mates therewith,
f. said lever being means for forcing the convex hammer against the concave anvil in mating relationship,
g. both hammer and anvil having a toroidal surface,
h. each of said toroidal surfaces having a minor chord and a major circle,
j. with clearance between the two surfaces at least as great as the thickness of the blank,
k. the crank pin parallel to the minor chord of both of the toroidal surfaces of the dies, and
m. the convex hammer moving through a path which is in the same plane of the major circle of both toroidal surfaces.

2. The invention as defined in claim 1 with the additional limitation of n. said convex hammer having a shape which will completely fit within said major circle.

3. The invention as defined in claim 1 with an additional limitation of n. said anvil mounted for movement on said base.

4. The invention as defined in claim 1 with additional limitations of n. said anvil mounted for movement on said base, and
o. said convex hammer having a shape which will completely fit within said major circle.

5. A machine to form a domed bracelet from a flat ductile metal blank comprising:

a. a base,
b. a shaft journaled to the base,
c. a lever attached to the shaft for rotating the shaft about its axis, d. a crank with a crank pin on the shaft,
e. a convex hammer journaled to the crank pin,
f. a concave anvil on the base positioned so that the convex hammer mates therewith,
g. both hammer and anvil having a toroidal surface,
h. each of said toroidal surfaces having a minor chord and a major circle,
j. with clearance between the two at least as great as the thickness of the blank,
k. the crank pin parallel to the minor chord of both of the toroidal surfaces of the dies, and
m. the crank pin following a path when moved by the lever which is in the same plane of the major circle of both toroidal surfaces.

6. The invention as defined in claim 5 with an additional limitation of
n. said convex hammer having a shape which will completely fit within said major circle.

7. The invention as defined in claim 5 with an additional limitation of
n. said crank in the form of a disc having considerable thickness to have desired inertia.

8. The invention as defined in claim 5 with an additional limitation of
n. said crank pin being near bottom dead center when working.

9. The invention as defined in claim 5 with an additional limitation of
n. the angle between the axis of the crank and the handle being less than 45°.

10. The invention as defined in claim 5 wherein said anvil includes:
n. a rocker block having said toroidal concavity therein,
o. a rocker shaft partially seated in
p. a slot in the bottom of the rocker block, and
q. said rocker shaft parallel to the crank pin.

11. The invention as defined in claim 5 with an additional limitation of
n. said anvil mounted for movement on said base.

12. The invention as defined in clam 11 wherein said anvil includes:
o. a rocker block having said toroidal concavity therein,
p. a rocker shaft partially seated in
q. a slot in the bottom of the rocker block, and
r. said rocker shaft parallel to the crank pin.

13. The invention as defined in claim 12 with an additional limitation of
s. the angle between the axis of the crank and the handle being less than 45°.

14. The invention as defined in claim 13 with the additional limitation of
t. said convex hammer having a shape which will completely fit within said major circle.

15. The invention as defined in claim 14 with an additional limitation of
u. said crank pin being near bottom dead center when working.

16. The invention as defined in claim 15 with an additional limitation of
v. said crank in the form of a disc having considerable thickness to have desired inertia.

* * * * *